US005253868A

United States Patent [19]

Baumann et al.

[11] Patent Number: 5,253,868

[45] Date of Patent: Oct. 19, 1993

[54] GOLF CLUB PUTTER

[76] Inventors: Peter E. Baumann, 1351 Ridge Dr., Yreka, Calif. 96097; Terry Wiens, 1814 196th Street, Langley, BC, Canada, V3A 4P4; Bill Featherson, Box 1939, Squamash, B.C., Canada, V0N 3G0

[21] Appl. No.: 891,870

[22] Filed: Jun. 1, 1992

[51] Int. Cl.[5] ..... A63B 53/02

[52] U.S. Cl. ..... 273/80 R; 273/167 F; 273/80.2; 273/80 C; 273/167 G; 273/167 H

[58] Field of Search ..... 273/80 R, 80 A, 80 B, 273/80 C, 80.1, 80.2, 80.8, 81 R, 167–175; D21/214, 210, 211, 221, 222

[56] References Cited

U.S. PATENT DOCUMENTS

| | | | |
|---|---|---|---|
| D. 193,436 | 8/1962 | Patrick | D21/211 |
| D. 268,123 | 3/1983 | Dretzke | D21/211 |
| 3,567,227 | 3/1971 | Panks | 273/80 C X |
| 3,595,577 | 7/1971 | Hodge | 273/80 C |
| 3,625,517 | 12/1971 | Durnack | 273/80 C X |
| 3,837,647 | 9/1974 | Jacques | 273/81 R |
| 3,843,122 | 10/1974 | Florian | 273/80.8 X |
| 3,851,880 | 12/1974 | Ritch | 273/129 K X |
| 4,725,062 | 2/1988 | Kinney | 273/80 C X |
| 4,852,879 | 8/1989 | Collins | 273/80 A X |
| 4,881,737 | 11/1989 | Mullins | 273/80 A |

FOREIGN PATENT DOCUMENTS

| | | | |
|---|---|---|---|
| 3118 | of 1908 | United Kingdom | 273/80 C |
| 727051 | 3/1955 | United Kingdom | 273/167 F |
| 81/00521 | 3/1981 | World Int. Prop. O. | 273/80 B |

*Primary Examiner*—Vincent Millin
*Assistant Examiner*—Sebastiano Passaniti
*Attorney, Agent, or Firm*—Hugh D. Jaeger

[57] ABSTRACT

A golf club putter including a reversed shaft, with a thin end in the grip and a thick end in the head, a shaft at the true center of gravity, and a shaft through a tapered hole in the head. The golf club putter can also include a head with hollow construction at the exact center of the head providing the putter head with a true and exact toe-heel balance relative to a shaft. The reverse tapered shaft slides through the putter head, and frictionally engages in the head with a thin end of the shaft in a grip and a thick end of the shaft in the head. In the alternative, the shaft can glue onto a pin extending upwardly from the putter head.

4 Claims, 6 Drawing Sheets

FIG. 6
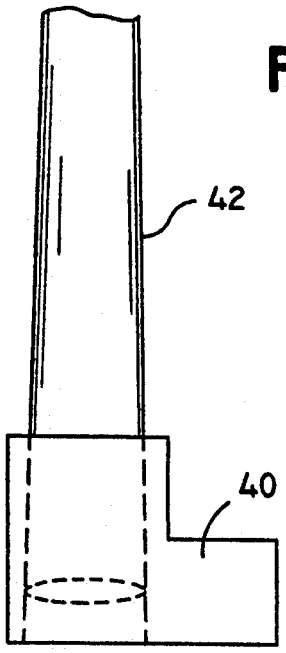
FIG. 9
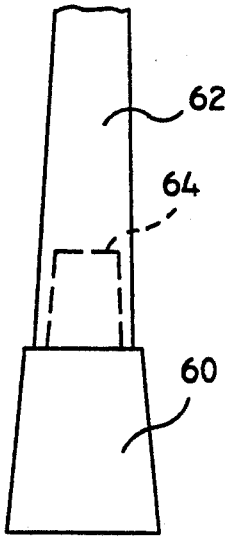
FIG. 7
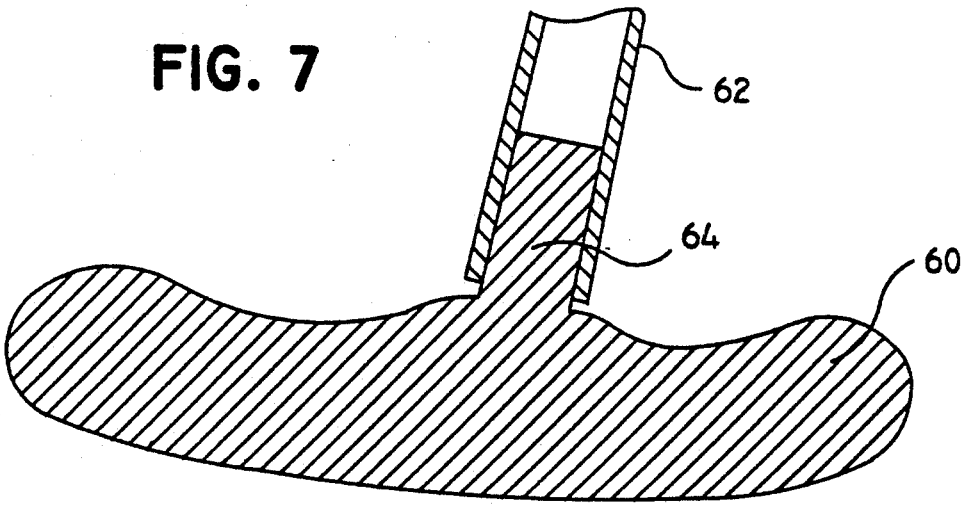
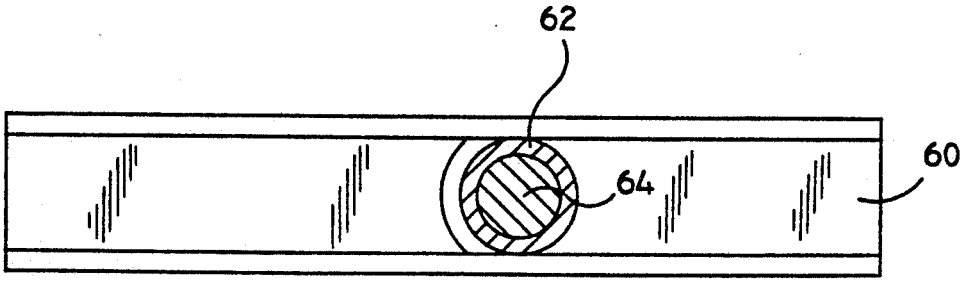
FIG. 8

GOLF CLUB PUTTER

BACKGROUND OF THE INVENTION

1. Field of the Invention

The present invention pertains to a golf club, and more particularly, pertains to a putter.

2. Description of the Prior Art

Prior art putters have not had a combination of the features of a reversed shaft, the shaft inserted through the head, and the shaft engaging the head at the true center of gravity.

The present invention overcomes the disadvantages of the prior art.

SUMMARY OF THE INVENTION

The general purpose of the present invention is to provide a golf club putter with a reversed shaft to dampen any shakiness at the hands by the time the stroke reaches the hand, a shaft inserted through the head so that the shaft and the head work together, and the shaft meeting the head at the true center of gravity so that the golfer can address and make contact with the ball at any one of the following three locations. The first location is at the center of the head for straight putts. The second location is at the toe to reduce the break in the right to left breaking putts. The third location is at the heel to reduce the break in left to right breaking putts. A hollow area can be provided in the center of the head to maximize toe-heel weighting benefit, providing for the three locations of the ball making contact with the head. In the event that a thin head is utilized, then the shaft is glued to the head at the true center of gravity. The center balance putter head engages the thick end of the putter shaft which is tapered. The thin end of the tapered putter shaft is inserted through an oval hole in the bottom of the putter head, then inserted all the way until the thick end of the tapered shaft engages into the hole with the frictional engagement essentially locking the shaft into position in the oval hole even though the thick end of the shaft is round.

In this putter, the shaft is fixed from the grip to the head, thin to thick, making the putter feel much more flexible in a golfer's hands. The putter blade is center balanced making the sweet spot, the center of gravity, coincide with a point where the shaft engages the putter head. A shaft hole through the putter head blade is oval to cinch the round shaft, thereby locking the shaft of the putter head without glue.

Significant aspects and features of the present invention include a putter shaft which is fixed thin to thick from the grip to the head. The putter blade is center balanced at the shaft. The putter blade is also fixed to the shaft mechanically without any glue, or other securing structure. The oval hole that engages the shaft keeps the putter head from twisting. The putter head can be custom weighted through the shaft at the base, such as with a hollow section, which can be filled with a different type of material. While the putter can be made of any suitable material, such as steel, brass or aluminum, the whole area can be filled with a different density of material.

Having thus described the embodiments of the present invention, it is one object hereof to provide a putter with a reversed shaft, with a thin end at the grip and a thick end at the head, the putter shafted at the true center of gravity, and a shaft extending through a tapered hole in the head.

Another object of the present invention is a putter shafted at the true center of gravity.

Another object of the present invention is a putter with a shaft which extends through the head.

A further object of the present invention is a putter with a reversed shaft.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 6 illustrates an end view of FIG. 4;

FIG. 7, a second alternative embodiment, illustrates a side view of a thin blade putter in use with a reversed tapered shaft;

FIG. 8 illustrates a top view of FIG. 7;

FIG. 9 illustrates an end view of FIG. 8;

DETAILED DESCRIPTION OF THE DRAWINGS

Figure 1:
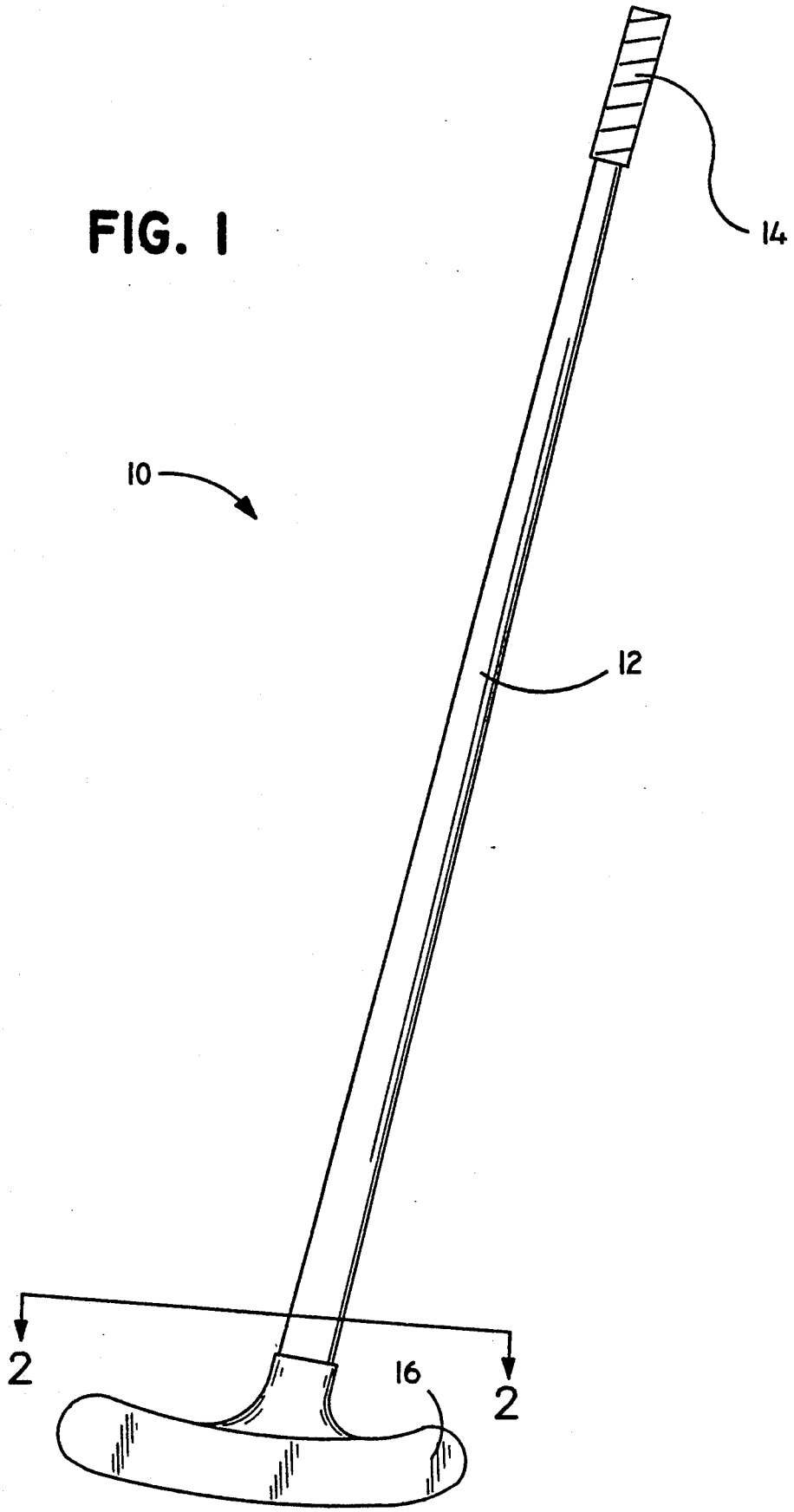
FIG. 1 illustrates a side view of a reversed taper shaft mallet putter.

FIG. 1 illustrates a side view of a mallet putter 10 including a reversed tapered shaft 12, a grip 14 and a mallet putter head 16. The reversed tapered shaft 12 is of a downwardly increasing radius, i.e., the radius of the tapered shaft 12 is the least at a point nearest the grip 14 and the greatest at its lower end near the lower region of the mallet putter head 16.

Figure 2:
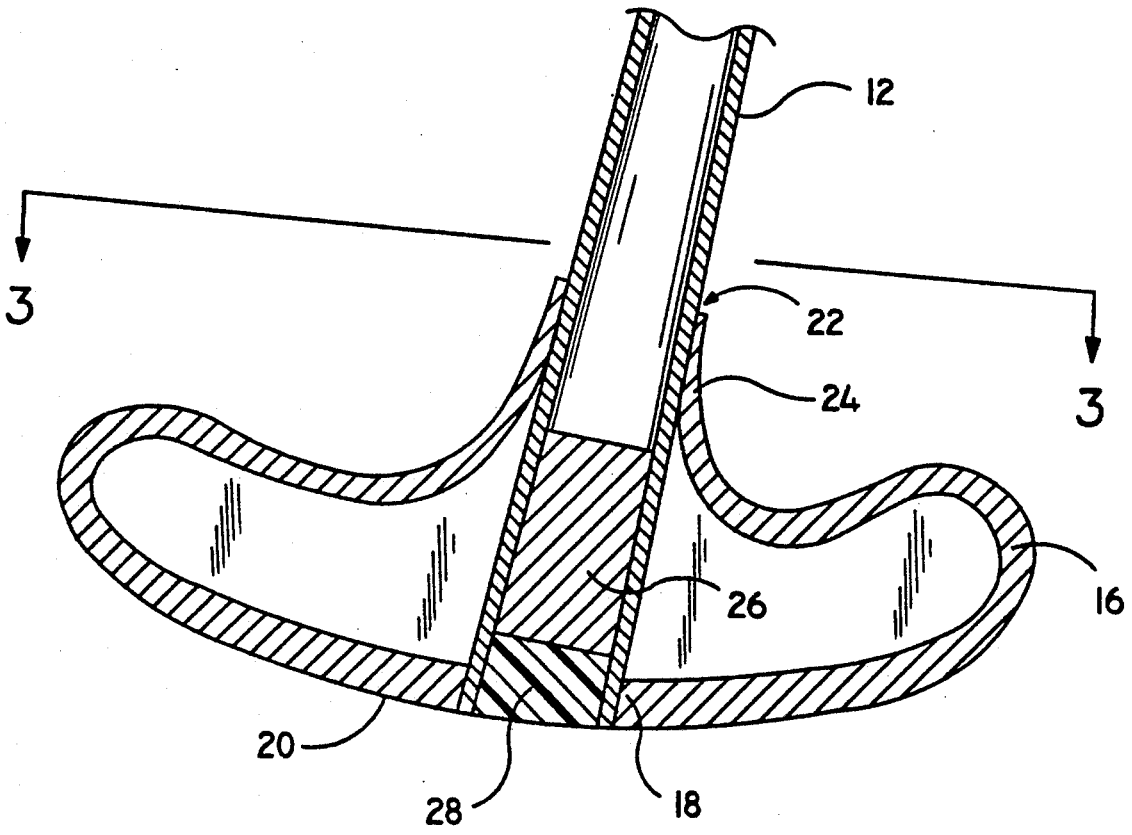
FIG. 2 illustrates a cross-sectional view of the reversed taper shaft mallet putter along lines 2—2 of FIG. 1.

FIG. 2 illustrates a cross-sectional view of the mallet putter head 16 where all numerals correspond to those elements previously described. The mallet putter head 16 is of bronze or other suitable material, and is of hollow construction at the exact center of the head, to give the putter head a true and exact toe-heel balance relative to the shaft. This true toe-heel balance will give the user better accuracy when striking putts exactly opposite the shaft, at the center of the face. It will also give the user the option of addressing and striking the ball at designated points on the toe or the heel to reduce the amount of break in breaking putts. While virtually all other putters are toe-heavy in relation to the shaft, thus leading to the face opening at impact, this putter will let a right-handed putter address and strike the ball at the toe of the putter blade when confronted with a right to left breaking putt, thus reducing the amount of break in the putt and increasing the number of such putts that will be made by such a stroke. Similarly, the user will be able to address and strike the ball at the heel of the putter when confronted with left to right breaking putts, thus reducing the amount of break in said putts and increasing the number of such putts that will be made by such a stroke. The same principle applies to left-handed putters using the opposite face. A hole 18 is canted approximately 5°, for purpose of illustration only and not to be construed as limiting of the present invention, and is located in the bottom surface 20 in alignment with another smaller radius canted hole 22 in the neck 24 of the mallet putter head 16. The holes 18 and 22 are aligned and properly sized to frictionally engage the taper of the tapered shaft 12 in order to form a strong mechanical union of the tapered shaft 12 and the mallet putter head 16 without the use of fastening devices, such as screws, adhesives or the like. A weight 26, such as lead or other suitable material, can reside in the lower end of the tapered shaft 12 between holes 22 and 18 for a weighted feel of the mallet putter 10. The weight 26 may be varied to provide a desirable feel for each individual golfer. A plastic plug 28 can also secure in the bottom end of the tapered shaft 12 for containment of the weight 26 in the lower region of the tapered shaft 12. The tapered shaft 12 is aligned at the true center of gravity of the mallet putter head 16.

Figure 3:
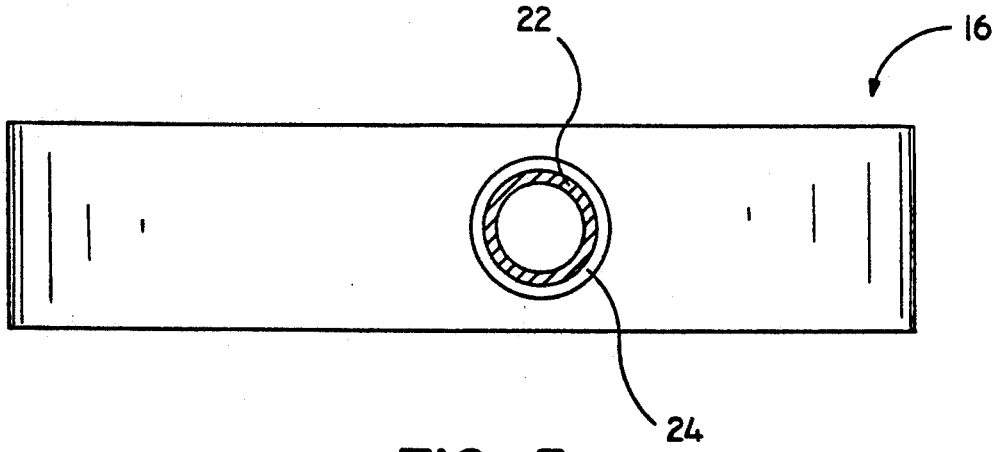
FIG. 3 illustrates a top view in cross section of the reversed taper shaft mallet putter along lines 3—3 of FIG. 2.

FIG. 3 illustrates a top view in cross section of the mallet putter head 16 where all numerals correspond to those elements previously described.

MODE OF OPERATION

Since the shaft meets the head of the putter at the true center of gravity, the golfer can address and make contact with the ball at any one of three locations. The first location is at the center of the head for straight putts. The second location is at the toe to reduce the break for right to left breaking putts. The third location is at the heel to reduce the break in left to right breaking putts. A hollow area in the center of the head can also be provided to maximize toe to heel weighting benefit providing for the above contact points with the ball at any of the three locations listed above.

Reference is made to the attached Appendix 1, a picture of the golf club putter.

DETAILED DESCRIPTION OF THE FIRST ALTERNATIVE EMBODIMENT

Figure 4:
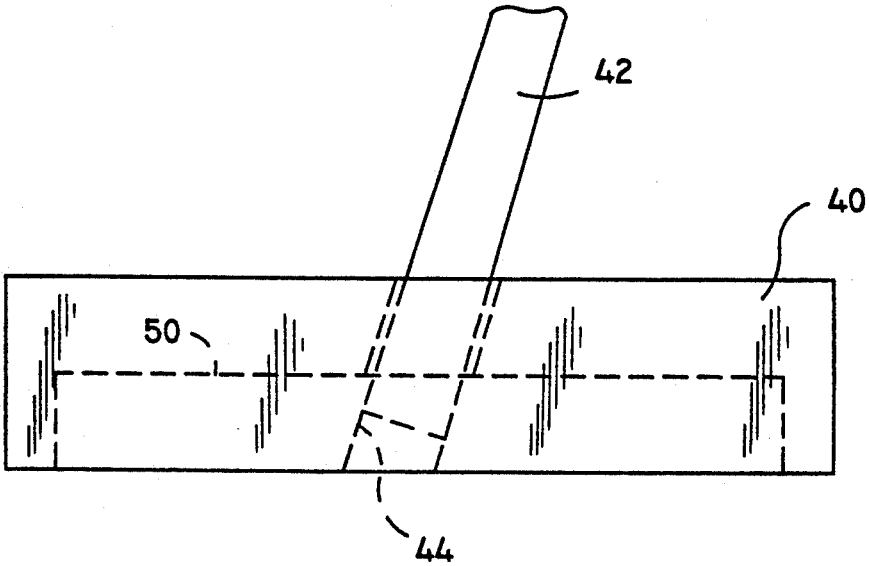
FIG. 4, a first alternative embodiment, illustrates a front view of a block head putter in use with a reversed tapered shaft.

FIG. 4, a first alternative embodiment, illustrates a front view of a block putter head 40 used with a tapered shaft 42 being in all respects similar to the tapered shaft 12 in FIG. 1. An optional hollow volume 52, as illustrated in dashed lines, can be utilized in the golf club putter of the present invention.

Figure 5:
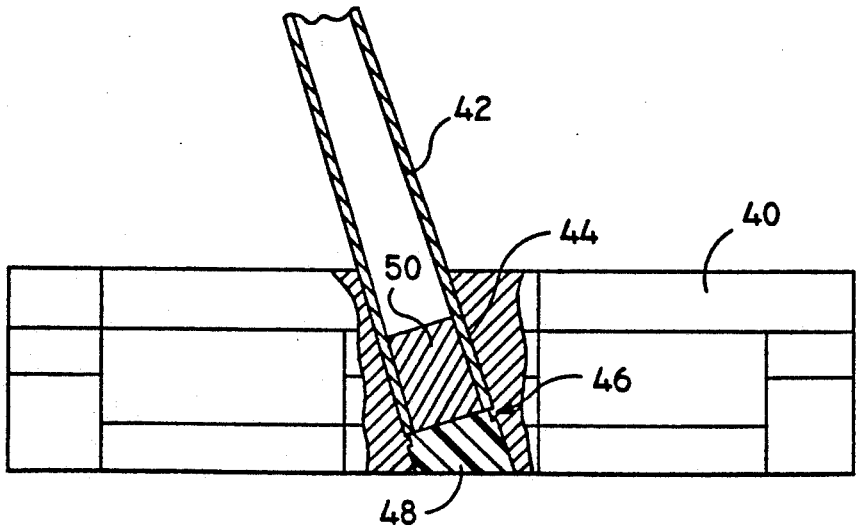
FIG. 5 illustrates a back view in cross section of FIG. 4.

FIG. 5 illustrates a back view in cutaway of the block putter head 40 in frictional engagement with a tapered shaft 42. A canted and tapered hole 44 in the body of the block putter head 40 includes a ridge 46 for seating of the end of the tapered shaft 42. A plastic plug 48 suitably engages the lower end of the tapered shaft 42 to contain a weight 50 in the lower end of the tapered shaft 42. The weight 50 may be varied to afford the desired feel for the individual golfer.

FIG. 6 illustrates an end view of FIG. 4 where all numerals correspond to those elements previously described.

MODE OF OPERATION

The mode of operation is similar to that of the mode of operation previously described for FIGS. 1–3.

DETAILED DESCRIPTION OF THE SECOND ALTERNATIVE EMBODIMENT

FIG. 7, a second alternative embodiment, illustrates a side view of a thin blade balanced bronze putter head 60 in use with a tapered shaft 62, which in all respects is similar to the tapered shaft 12 of FIG. 1 with the exception of the method of mounting to the thin blade putter head 60. An integral tapered shaft 64 extends at an appropriate angle from the thin blade putter head 60 to glue, or other adhesive materials, the lower end of tapered shaft 62. In the alternative, the upwardly extending shaft can be a pin or stub on the top of the head.

FIG. 8 illustrates a top view of FIG. 7 where all numerals correspond to those elements previously described.

FIG. 9 illustrates an end view of FIG. 8 where all numerals correspond to those elements previously described.

MODE OF OPERATION

The mode of operation is similar to that of the mode of operation previously described for FIGS. 1–3.

DETAILED DESCRIPTION OF THE THIRD ALTERNATIVE EMBODIMENT

Figure 10:
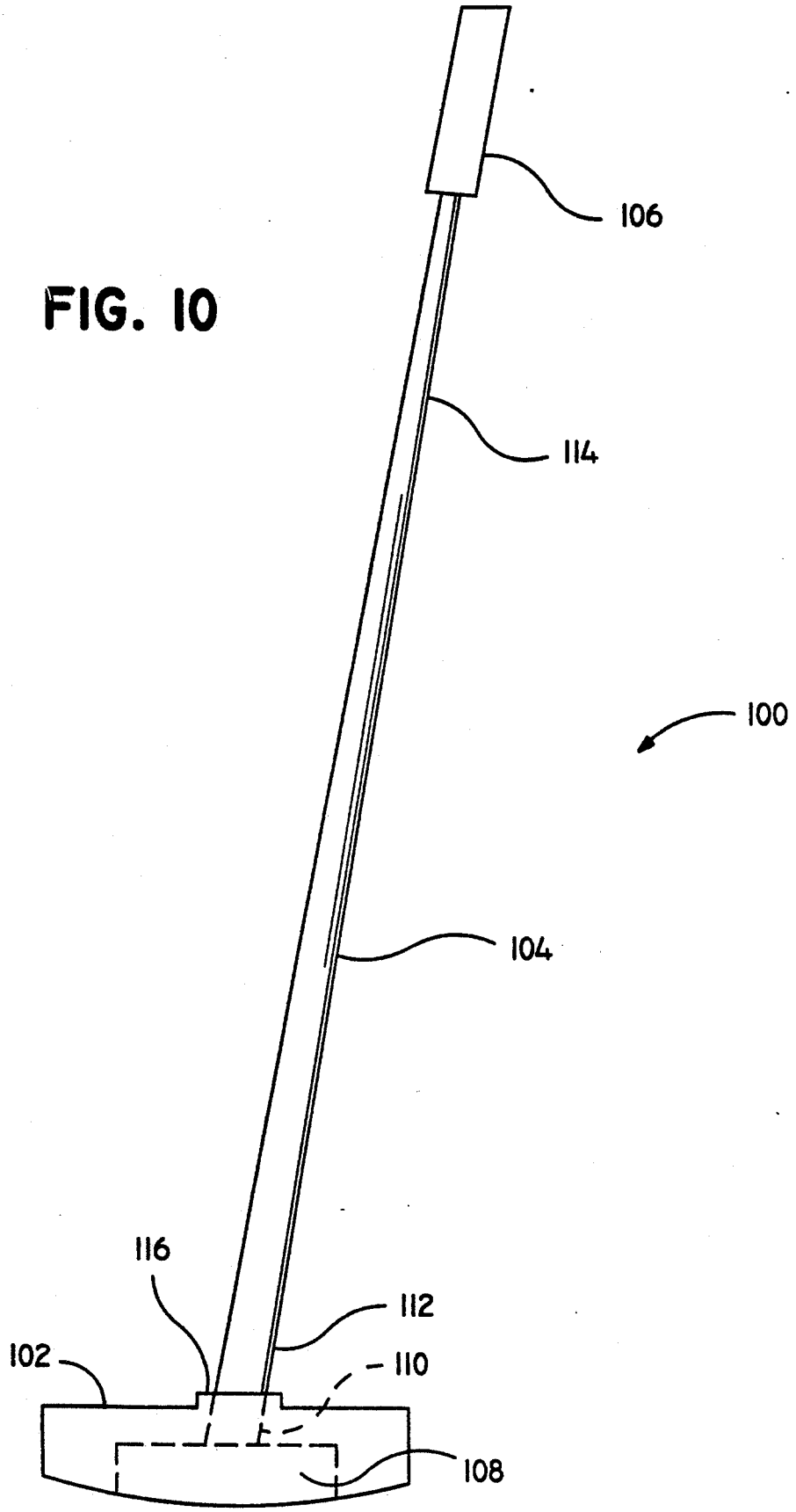
FIG. 10 illustrates a perspective view of a third alternative embodiment of a golf club putter.

FIG. 10 illustrates a perspective view of a golf club putter 100, the third alternative embodiment, including a head 102, a reversed shaft 104, and a grip 106. A hollow area 108 is provided in the head 102. A hole 110 is provided to engage with the shaft 104. The thick end of the shaft 112 engages into the hole 110, and the thin end of the shaft 114 engages into the grip 106. A upwardly extending member 116 provides further support for the thick end of the shaft 112. The shaft 104 is inserted through the head 110 at a true center of gravity. The hollow area 108 can be filled with any suitable material, such as material of a different density than that of the material the head 102.

Figure 11:
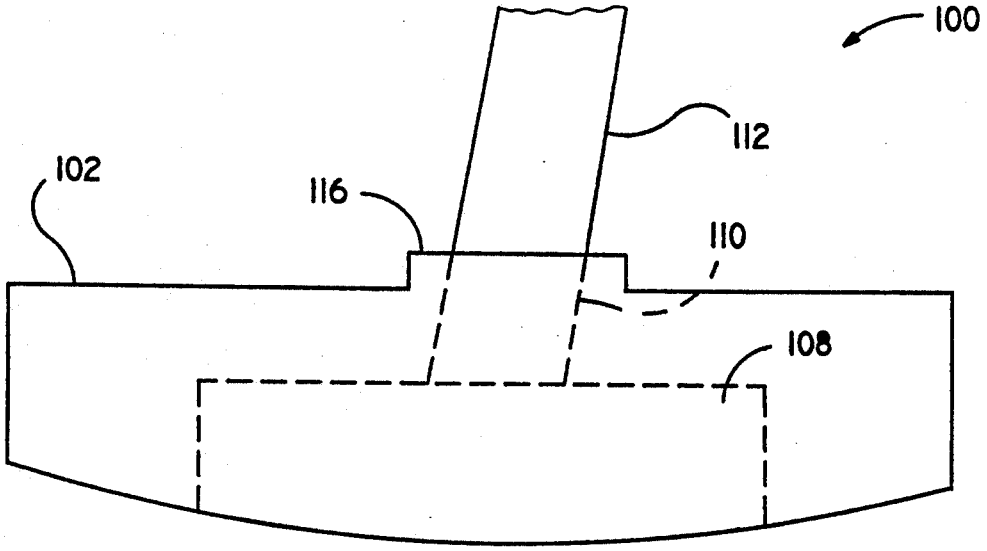
FIG. 11 illustrates a front view of a head for the golf club putter.

FIG. 11 illustrates a front view of the head 102 of FIG. 10 where all numerals correspond to those elements previously described.

Figure 12:
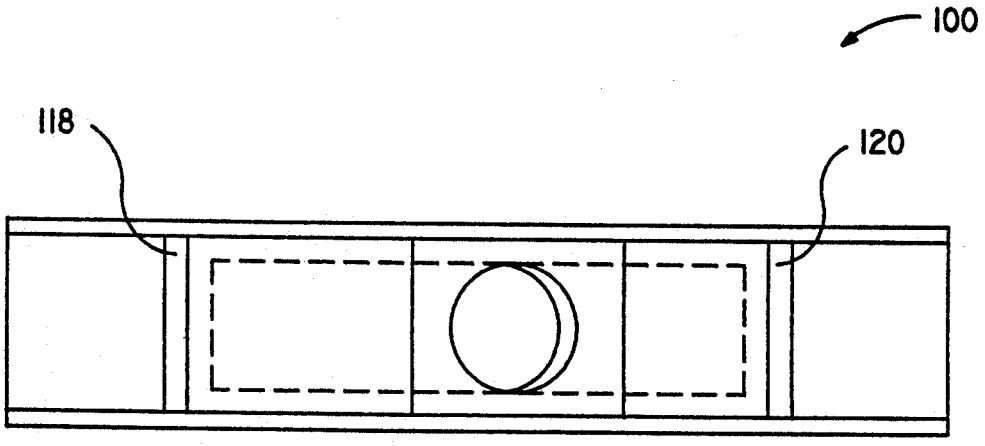
FIG. 12 illustrates a top view of a head of FIG. 11 for the golf club putter; and, FIG. 13 illustrates a bottom view of the head of FIG. 11 for the golf club putter.

FIG. 12 illustrates a top view of the head 102 of FIG. 11 where all numerals correspond to those elements previously described. Alignment lines 118 and 120 are provided for the precise striking of the ball as previously discussed in the mode of operation. The alignment lines toward the toe for right to left breaking putts, and at the alignment line toward the heel for left to right breaking putts.

Figure 13:
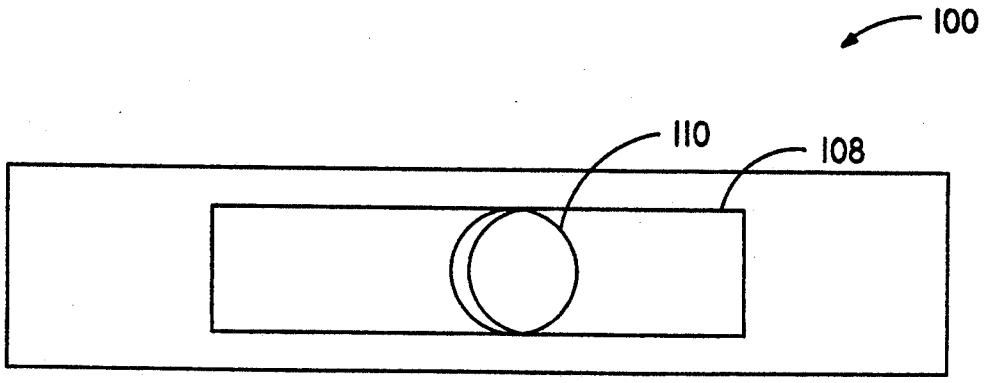

FIG. 13 illustrates a bottom view of the head 102 of FIG. 11 where all numerals correspond to those elements previously described.

MODE OF OPERATION OF THE THIRD ALTERNATIVE EMBODIMENT

The reversed shaft (thin end in the hands and fat end at the head) enables one to stroke putts more smoothly. The flex is near the hands, thus dampening any shakiness in the stroke by the time the stroke reaches the head. This reduces or eliminates the "yips". Virtually all previous putter designs have a "toe-heavy" head in relation to the shaft. Balance the putter shaft in one's palm and the toe does not dip downward. The golf club putter is the first true putter with the shaft entering the head at the center of gravity. The result is a true toe-heel balance that keeps one's putts starting where one wants them to start, and rolling forward, without any side spin. Virtually all other putters, being toe-heavy, cause the head to open at impact. That is why right-handed putters like right-to-left breaking putts. The face opening at impact puts side spin on the ball that reduces the break in the putt. One knows that the less a putt breaks, the better the chances of making it. In this case the toe-heavy putter head causes the putt to break more than normal for left to right breaking putts. With the golf club putter of the present invention, true center of gravity putter, merely address and stroke the ball at the center of the face for a straight putt, at the alignment line toward the toe for right-to-left breaking putts, and at the alignment line toward the heel for those dreaded left-to-right breaking putts. If one is pushing one's putts, simply address and stroke the ball off of the alignment line on the heel of the golf club putter. The balance of the golf club putter moves the ball back on line. If one is pulling one's putt, simply address and stroke the ball off the alignment line at the toe of the golf club putter. The balance in the head will push the putt back on line.

The putter can be produced in several sizes and weights of loads. For heavier putter heads, the weight of the head and flexibility at the hands provides for a slow, smooth stroke.

Various modifications can be made to the present invention without departing from the apparent scope hereof.

I claim:

1. A golf club comprising;

a. a clubhead body having a top and a bottom, and a center of gravity located within said body;

b. a pin means extending upwardly from said top of said clubhead body and having a longitudinal axis extending therethrough, said longitudinal axis, when extended, intersecting the center of gravity of said clubhead body, said pin means being secured to said clubhead body, said pin means having a proximal end adjacent to said top of said clubhead body and a distal end opposite to said proximal end and spaced from said top of said clubhead body;

c. an elongated reverse tapered shaft having a grip end and a tip end;

d. said reverse shaft continuously tapering radially inwardly from a larger outside diameter adjacent said tip end to a smaller outside diameter adjacent said grip end;

e. said shaft being secured to said pin means such that said tip end of said shaft matingly engages said pin means.

2. The golf club of claim 1 wherein said club is a putter.

3. The golf club of claim 1 and further comprising a hollow cavity in an lower internal portion of said clubhead body.

4. The golf club of claim 3 wherein said hallow cavity is filled with a material different from that from which the clubhead body is formed.

* * * * *